US005371971A

United States Patent [19]

Prete

[11] Patent Number: 5,371,971

[45] Date of Patent: Dec. 13, 1994

[54] SASH BALANCE BRAKE AND PIVOT PIN ASSEMBLY

[75] Inventor: James G. Prete, Hinsdale, Ill.

[73] Assignee: Ashland Products, Inc., Chicago, Ill.

[21] Appl. No.: 57,266

[22] Filed: May 4, 1993

[51] Int. Cl.[5] ..... E06B 3/32

[52] U.S. Cl. ..... 49/380; 49/181

[58] Field of Search ..... 49/380, 181, 177, 176, 49/161; 16/197

[56] References Cited

U.S. PATENT DOCUMENTS

| | | | |
|---|---|---|---|
| 3,464,160 | 9/1969 | Anderson | 49/181 |
| 3,524,282 | 8/1970 | Kraft et al. | 49/181 |
| 3,643,377 | 2/1972 | Anderson | 49/181 |
| 4,590,708 | 5/1986 | Campodonico | 49/181 |
| 4,610,108 | 9/1986 | Marshik | 49/181 |
| 4,718,194 | 1/1988 | FitzGibbon et al. | 49/181 |
| 4,763,445 | 8/1988 | Silverman | 49/176 |
| 4,813,180 | 3/1989 | Scalzi . | |
| 5,069,001 | 12/1991 | Makarowski | 49/176 |
| 5,077,939 | 1/1992 | Erickson | 49/380 |
| 5,237,775 | 8/1993 | Hardy | 49/181 |
| 5,243,783 | 9/1993 | Schmidt . | |

*Primary Examiner*—Peter M. Cuomo
*Assistant Examiner*—Jerry Redman
*Attorney, Agent, or Firm*—Wallenstein, Wagner & Hattis, Ltd.

[57] ABSTRACT

A sash balance brake and pivot pin assembly for a sash window which maintains the window substantially square prior to installation is disclosed. The pivot pin extends outwardly from the window sash. The sash balance brake is disposed within a track in the window frame and includes a cam rotatably disposed within an expandable housing. The pivot pin has a collar for lateral engagement with the cam to prevent the window frame from bowing away from the window sash, thereby maintaining the window frame substantially square.

10 Claims, 2 Drawing Sheets

SASH BALANCE BRAKE AND PIVOT PIN ASSEMBLY

DESCRIPTION

1. Technical Field

This invention relates to a pivotable sash window mounted in a frame and, more particularly, to a sash balance brake and pivot pin assembly which cooperates with the frame to prevent the frame from bowing, such as during shipment and installation.

2. Background Prior Art

Pivotable sash window assemblies are well known in the art. Typically, these assemblies include a rotatable brake assembly actuated by rotation of a pivot pin when the sash of the window is pivoted from its vertical position to a non-vertical position. The brake assembly locks the sash balance relative to the window frame when the sash is pivoted, thereby preventing the sash from springing up.

Makarowski, U.S. Pat. No. 5,069,001, discloses a sash retaining pivot assembly having a T-shaped bar projecting from the sash into the window frame channel, where wings on the T-shaped bar engage the inside of the window frame so that sash to frame alignment is maintained. The T-shaped bar also acts as a pivotal axis about which the sash is tilted and the sash retaining pivot assembly provides integral locking of the window sash within the window frame at the pivot location.

Erickson, U.S. Pat. No. 5,077,939, discloses a cam pivot having a locking lug received between the walls of a channel-shaped slide member of the locking terminal when the sash is tilted to its vertical position. The locking lug prevents separation of the cam pivot from its locking terminal during shipment.

Anderson, U.S. Pat. No. 3,643,377, discloses a tilting double hung window structure wherein a single plastic guide member is inserted in the frame at each side of the jambs and serves the multiple purposes of providing required compression between the frame and sash to maintain the sash in adjusted positions, guiding the sash in vertical movement and weatherstripping between the sash and frame. The patent also describes a two-part camming and locking structure to permit tilting of the sash. The use of packing and shipping clips to maintain the frame in a predetermined relation to the sash are also described. The clips are inserted in a recess of the frame jambs and placed in a surface to surface engagement with the bottom of the sill of the upper sash. The clips are secured into place by fastening means.

Anderson, U.S. Pat. No. 3,464,160, discloses a tilting double hung window construction including a single plastic guide member at each side of the window sash to provide compression between the sash and frame and weatherstripping therebetween, as well as, guiding the sash in a sliding motion relative to the frame. A camming locking structure for securing the sash in a vertical position is also disclosed.

Westphal, et al., U.S. Pat. No. DES 319,576, describes an ornamental design for a pivot bar component of a tiltable window sash.

While several of the patents above describe pivotable window sash assemblies, none describe the combination sash balance brake and pivot bracket assembly disclosed by Applicant. There remains a need for a simple and reliable method to secure a tiltable window sash in the vertical position to the frame to prevent the jambs of the frame from bowing out and distorting from the sash, such as during shipment and installation.

The present invention is provided to solve these and other problems.

SUMMARY OF THE INVENTION

It is an object of the invention to provide a sash balance brake and pivot pin assembly for a sash window which maintains the window substantially square prior to installation.

In accordance with the invention, the pivot pin extends outwardly from the window sash. The sash balance brake is disposed within a track in the window frame and includes a cam rotatably disposed within an expandable housing. The pivot pin has a collar for lateral engagement with the cam to prevent the window frame from bowing away from the window sash, thereby maintaining the window frame substantially square.

Other features and advantages of the invention will be apparent from the following specification taken in conjunction with the following drawings.

DETAILED DESCRIPTION OF A PREFERRED EMBODIMENT

Figure 1:
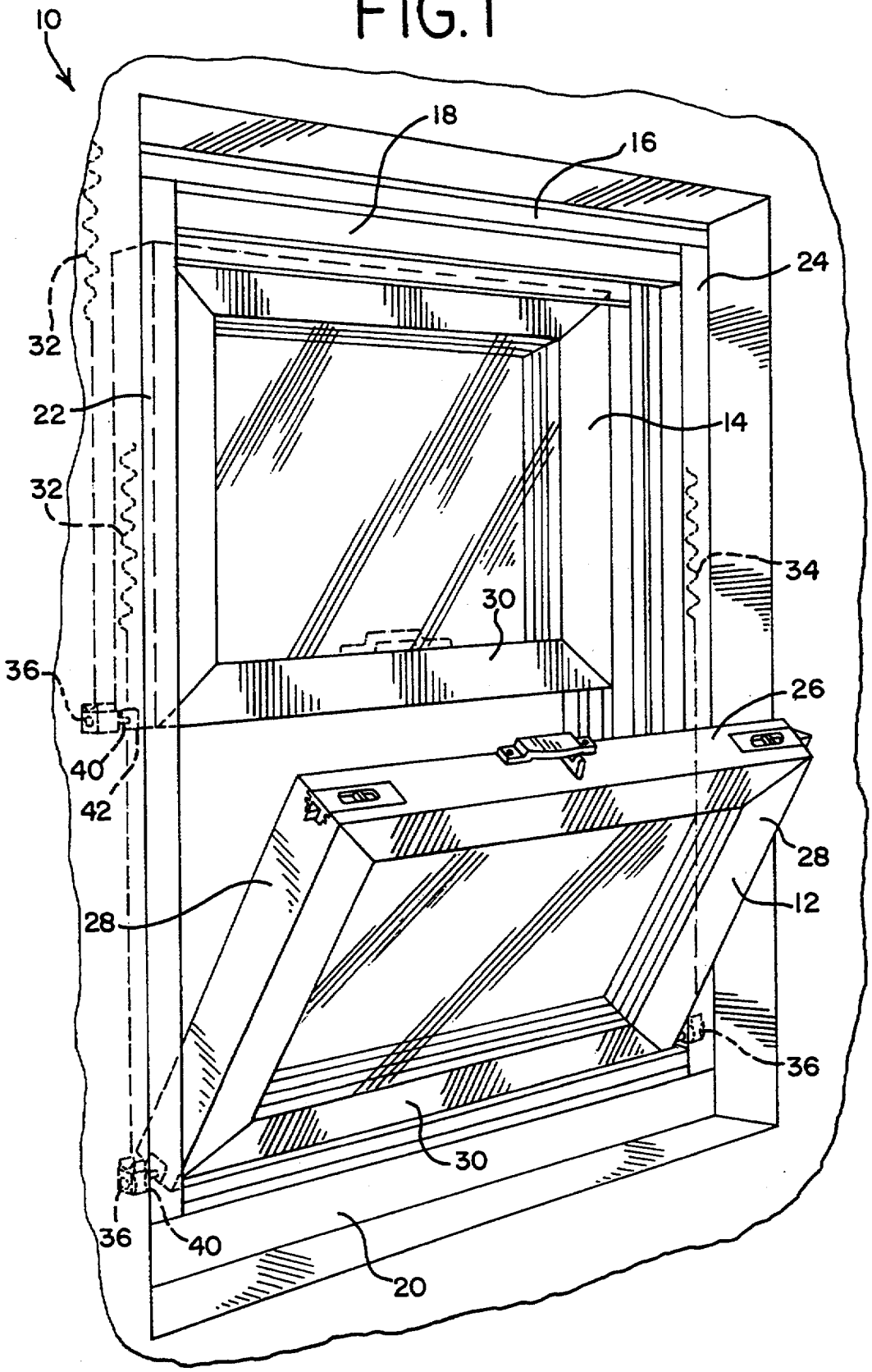
FIG. 1 is a perspective view of a double-hung window assembly including combination sash balance brake and pivot bracket assemblies.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A conventional pivotable double hung sash window system, generally designated 10, is disclosed in FIG. 1. As is well known, the window system 10 is vertically mounted in a conventional fashion in a wall or other similar structure. The window system 10 includes a lower sash 12 and an upper sash 14, reciprocally mounted within a window frame 16. The window frame 16 includes a header 18, a sill 20, a left jamb 22, and a right jamb 24. The lower sash 12 and upper sash 14 each include a sash top header 26, two opposing sash stiles 28 and a sash base 30. In general, the form of the sashes 12, 14 and jambs 22, 24 follow a conventional structure and form.

As is well known, the window system 10 includes a pair of sash balances 32, 34 for each of the respective sashes 12, 14. The sash balances 32, 34 provide an upward force to counter the weight of the respective sashes 12, 14. Because the sashes 12, 14 are pivotable, brake assemblies 36 are provided. A pair of opposing pivot pins 40, one extending outwardly from each side of each of the sashes 12, 14, engage each of the brake assemblies 36. Rotation of the pivot pins 40 upon pivoting of the sashes 12, 14 locks the brake assemblies 36, and hence disables the respective sash balances 32, 34, when the respective sashes 12, 14 are pivoted away from the vertical position.

As previously discussed, there has been a tendency for frame jambs to bow outwardly before window systems have been placed in a wall. In order to overcome this problem, the pivot pins 40 of the present invention are laterally secured to their respective brake assemblies 36, to prevent, or otherwise minimize, outward bowing of the window frame.

Referring to FIGS. 2–7, a generally L-shaped pivot bracket 42 is provided integral with the pivot pin 40. The pivot bracket 42 is adapted for attachment to the lower corners of the window sashes 12, 14. The pivot bracket 42 has a first leg 44, having a first recessed screw hole 46. The pivot bracket 42 also has a second leg 48, having a second recessed screw hole 50. Screws, not shown, are conventionally disposed through the first screw hole 46 and second screw hole 50, to secure the pivot bracket 42 to window sashes 12, 14. The pivot bracket 42 further has a registration pin 52 which aligns with a corresponding alignment cavity (not shown) in sashes 12, 14. Sashes 12, 14 typically have a groove (not shown) complementary to the shape of the bracket 42, so that the bracket 42 is flush mounted to the sashes 12, 14. The bracket 42 includes a cut-out rectangular portion 54 to allow for any excess window weld material, which occasionally results at the window corner. It is to be understood that the pivot pin 40 of the invention could be integral with the sashes 12, 14, rather than being secured thereto by the bracket 42.

Figure 5:
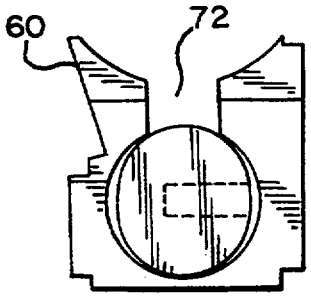
FIG. 5 is a cross section taken along line 5—5 of FIG. 2 of the combination sash balance brake with the pivot pin inserted within the oval drum shaped drum and showing the cam turned 90 degrees so that the pivot pin is in a locked position within the drum.

The sash balance brake assemblies 36 for conventional attachment to the sash balances 32, 34, include a cam 56 having a generally U-shaped cavity 58 of cross section similar to that of the pivot pin 40. The cam 56 is disposed within an expandable housing 60. The pivot pin 40 is received by the U-shaped cavity 58 of the cam 56, such that rotation of the pivot pin 40 upon pivoting of the sashes 12, 14 rotates the cam 56, thereby expanding the expandable housing 60 to thereby lock the housing 60 in its place and in its respective track. The cam 56 also has a solid circular covering 62 corresponding generally to the shape of a side housing opening 64, which is also substantially circular as shown in FIG 5.

Figure 7:
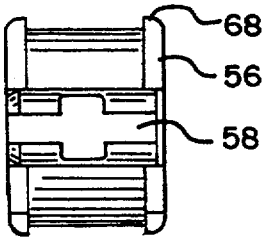

As is well known, the sash balance brake assemblies 36 are laterally restrained within the track. In accordance with the present invention, a collar 66 is circumferentially disposed about the pivot pin 40. The collar 66 is placed in the U-shaped cavity 58, which laterally secures the pivot pin 40 relative to the cam 56. The covering 62 of the cam 56 includes a radially extending member 68, which laterally engages a recess 70 along the outer surface of the expandable housing 60. The member 68 extends the full circumference of the cam 56, though it could extend a lesser length. The member 68 prevents the cam 56 from moving inward relative to the housing 60. Thus, when the collar 66 of the pivot pin 40 is placed in the U-shaped cavity 58 of the cam 56 as shown in FIG 7, the pivot pin 40 is prevented from moving inwardly relative to the expandable housing 60. Hence, because the pivot pin 40 is attached to the sashes 12, 14 and because the window frame 16 is attached to the track retaining the housing 60, the window frame 16 is prevented from moving outwardly relative to the sashes 12, 14, thus acting as an anti-bow means for preventing the window frame 16 from laterally bowing prior to being mounted.

The pivot bracket 42 can be made from wood or metal, but is preferably molded from a plastic resin and more preferably from a 40% long glass-filled resin such as Isoplast by Dow Corning, for strength and durability. The collar 66 can be square, oval, or such other configurations as would be retained by the cam 56, but is preferably circular as shown.

Figure 2:
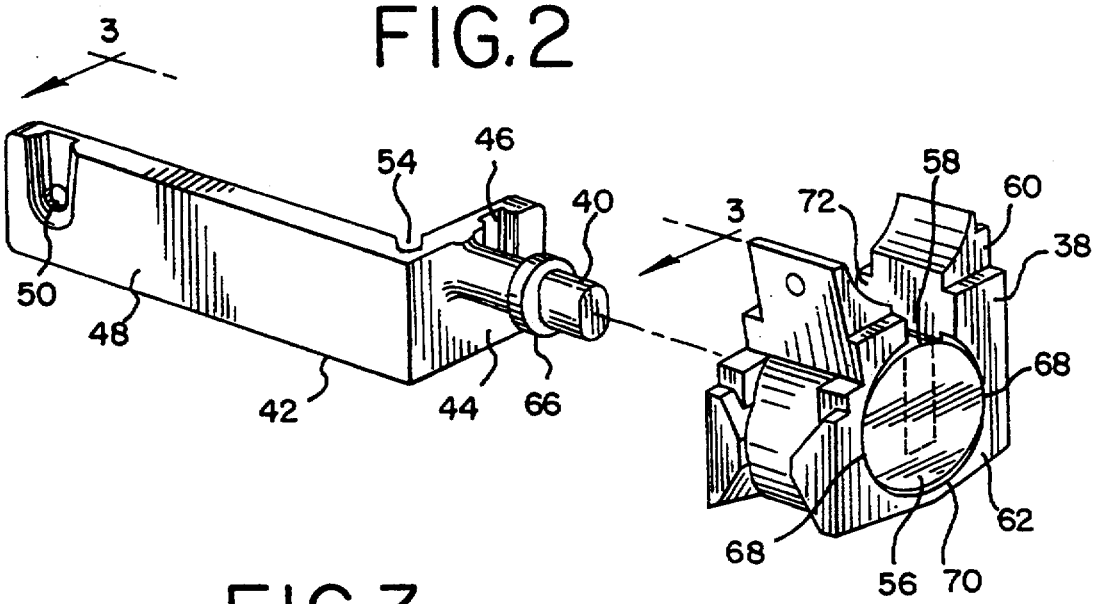
FIG. 2 is an exploded perspective view of the combination sash balance brake and pivot bracket assembly as it would appear when the window is pivoted 90° to an open position and the housing has been expanded to engage the balance brake.
Figure 3:
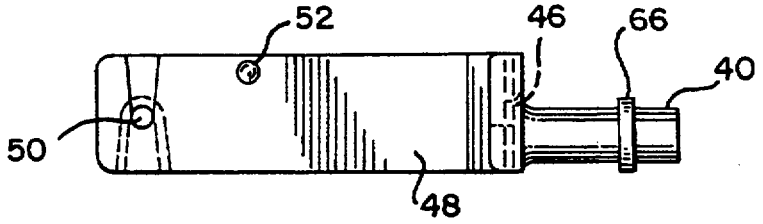
FIG. 3 is a top view of the pivot bracket taken along lines 3—3 of FIG. 2 showing the pivot bracket.
Figure 4:
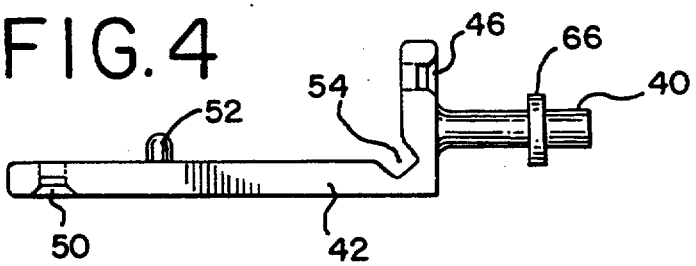
FIG. 4 is a side view of the pivot bracket of FIG. 3.
Figure 6:
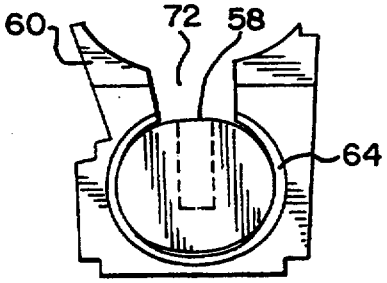
FIG. 6 is a view similar to FIG. 5 except that the oval drum having the pivot pin inserted therein is in a an unlocked position similar to that shown in FIG. 2; and, FIG. 7 is a top view of the sash balance brake having the oval drum inserted therein.

When sashes 12, 14 are tilted about 90 degrees, the sashes 12, 14 can easily be removed from the sash balance brake assemblies 36 because the opening to the U-shaped cavity 58 is aligned with the upper housing opening 72 of the expandable housing 60, as shown in FIGS. 2 and 6. However, when the sashes 12, 14 are pivotally in any other position, the collar 66 is retained in the cam 56, so that the sashes 12, 14 cannot be removed.

It will be understood that the invention may be embodied in other specific forms without departure from the spirit or central characteristics thereof. The present examples and embodiments, therefore, are to be considered in all respects as illustrative and not restrictive, and the invention is not to be limited to the details given herein.

I claim:

1. A sash balance brake assembly for a tiltable window structure adapted to be mounted in a wall, said window structure including a window and a frame, said frame having two spaced generally parallel and opposing tracks extending in a first direction, said sash balance brake assembly including a pair of brake units with one brake unit being slidable in and along each of said tracks in said first direction, said sash balance brake assembly further including a pair of opposed, elongated pivot pins adapted to be attached to said window in a position to extend outwardly from said window, said pivot pins having a coupling portion extending in a second direction generally perpendicular to said first direction, said coupling portions each having an outer end configuration to be operatively coupled in an interference fit to a respective one of said sash balance brake units to facilitate anti-bowing and reciprocal movement and locking of said window along said tracks; said brake unit comprising a flexible housing and a drum cam, said housing have a first opening therethrough, said first opening extending in said second direction through said housing, said drum cams each having a first end and a second end, said first end of said cam being insertable in said first opening along a path of travel generally in said second direction, said second end of said cam having an outwardly projecting means for preventing said second end from passing through said opening, said cam being rotatable in said first opening coaxially with said pivot pin at least 90°; said housing having a second or slot opening extending in a said second direction and communicating with and allowing access to said first opening from said first direction slot first opening, said first opening being larger than said slot opening whereby said cam cannot pass through said second opening; said cam having a first cam slot therein extending in said second direction, said first cam slot being of a configuration to receive from said first direction through said housing slot opening said outer end of said pivot pin therein in said interference fit whereby axial rotational movement of said pivot pin will cause corresponding axial rotational movement of said cam within said housing and whereby relative movement between said pivot pin and said cam in said second direction will be limited to maintain said frame substantially square relative to said window prior to being mounted in said wall and prevent bowing of said frame; said interference fit between said pivot pin and said cam being provided by a collar on each of said pivot pins received in a second slot in said cam, said collar being located inwardly from the outer end of each of said pivot pins and said collar extending radially outwardly from a circumferential surface of each of said pivot pins; said outer ends of said pivot pins each having a non-circular transverse cross sectional configuration; said second slot means in said cam being transversely disposed relative to and extending beyond the width of said first slot means, said second slot receiving said collar and said first slot receiving said outer end of said pivot pin, said cam and said first opening being of a shape relative to each other to not expand said housing when said cam is in a first position and to expand said housing when said cam is in a second position rotated about 90° from said first position.

2. The sash balance brake assembly of claim 1 wherein said collar has a width greater than the width of said slot opening in said housing and said housing is flexible and tapered toward said slot opening to allow said collar to be forced past said second opening into said second slot in said cam.

3. The sash balance brake assembly of claim 1 wherein each of said pivot pins are attached to said window by a bracket.

4. The sash balance brake assembly of claim 3 wherein each of said brackets has a first leg and a second leg, said second leg disposed substantially 90° to said first leg whereby said first leg is adapted for attachment to a bottom of said window sash and said second leg is adapted for attachment to a side of said sash window and said pivot pin extends outwardly from said second leg.

5. The sash balance brake assembly of claim 4 wherein each of said pivot pins is integral with said second leg.

6. The sash balance and brake assembly of claim 3 wherein each of said pivot pins is integral with said respective bracket.

7. The sash balance brake and pivot bracket assembly of claim 1 wherein said assembly is made of a plastic resin.

8. A combination sash balance brake and pivot bracket assembly comprising:

a sash balance brake unit and a pivot pin means; said sash balance brake unit including a brake and a cam mounted in an opening in said brake, said cam being rotatable about an axis, said cam having a first, axially extending slot therein, said first slot being smaller in a first direction horizontally transverse to said axis than in a second direction vertically transverse to said axis, said pivot pin being substantially equal in dimension to said slot in said first direction and larger than said slot in said second direction whereby rotary movement of said pivot about said axis in an arc from a first position to a second position causes said cam to rotate in a corresponding arc between a first position and a second position, said cam being configured relative to said opening whereby said cam causes said brake to have a greater outer dimension in said first direction when said cam is in said second position than when said cam is in said first position, said pivot pin having an integrally formed collar circumferentially disposed and radially extending from the outer surface thereof, said cam having a second slot extending in said first direction transverse to the axis of and extending beyond the dimension of said first slot, said pivot pin collar being vertically received in said second slot whereby said collar cannot move axially relative to said second slot.

9. The sash balance brake and pivot bracket assembly of claim 8 wherein said assembly is made of a plastic resin.

10. The assembly of claim 9 wherein said bracket is made of a 40% long glass-filled plastic resin.

* * * * *